US006596351B1

(12) United States Patent
Thompson

(10) Patent No.: US 6,596,351 B1
(45) Date of Patent: Jul. 22, 2003

(54) COLLECTIBLE DICE AND PACKAGING THEREFOR

(76) Inventor: Robert J. Thompson, 12907 Old Chapel Rd., Bowie, MD (US) 20720

( * ) Notice: Subject to any disclaimer, the term of this patent is extended or adjusted under 35 U.S.C. 154(b) by 0 days.

(21) Appl. No.: 09/476,818

(22) Filed: Jan. 3, 2000

(51) Int. Cl.[7] ..... A47G 33/04; A63F 9/04

(52) U.S. Cl. ..... 428/7; 428/13; 428/187; 273/146

(58) Field of Search ..... 463/10, 16, 22; 273/146, 144; D21/372, 354; 428/7, 167, 13, 76, 187, 207, 542.2; 40/427

(56) References Cited

U.S. PATENT DOCUMENTS 2,772,500 A * 12/1956 Cole et al. ..... 428/13
2,987,843 A * 6/1961 Anthony ..... 428/13
4,641,840 A 2/1987 Larson ..... 273/138
5,405,145 A * 4/1995 Jones et al. ..... 273/146
5,694,045 A 12/1997 Ikeda et al. ..... 273/146
5,803,461 A * 9/1998 Pavlovic ..... 273/292
5,865,435 A 2/1999 Ikeda et al. ..... 273/145 R
6,220,594 B1 4/2001 Peng ..... 273/146

* cited by examiner

*Primary Examiner*—Donald J. Loney

(57) ABSTRACT

Collectible dice wherein each is unique and includes a cube-shaped element defining six flat sides; indicia positioned on predetermined of the sides; and an electromagnetic radiation transmitting/transponding element embedded within the cube-shaped element for transmitting a unique identifying signal or code for reception and reading by a receiver/reader. A packaging system for each die includes a base for receiving the die thereon and covers for removably fitting onto the base and over the die.

2 Claims, 2 Drawing Sheets

COLLECTIBLE DICE AND PACKAGING THEREFOR

BACKGROUND OF THE INVENTION

This invention relates to collectible novelty items and more particularly to collectible, unique dice and a packaging system therefor.

Collection of novelty items and other products by collectors is a well known phenomenon. Over the years, various types of novelties and products have been collected, such as baseball cards, stuffed miniature animals and other items.

It is an object of the present invention to provide collectible, one-of-a-kind dice for accumulation and trading by collectors.

Another object is to provide a packaging system for the collectible dice.

A further object of the invention is the provision of collectible dice which are protected against forgeries or unauthorized duplication by use of an electromagnetic transmitter or transponder embedded within each die for transmitting a unique electromagnetic identifier signal or code.

Still another object is to provide a packaging system for the dice which hides each die from view until the package is opened.

A still further object is to provide a plurality of unique, collectible dice having different color-coded numbers and/or symbols located on the sides of each die.

Yet another object of the present invention is the provision of such collectible dice wherein millions of combinations of color-coded numbers and/or symbols on the sides of the dice are provided.

Another object is to provide such collectible dice wherein each color-coded number and symbol may be assigned a positive or negative numerical value for the purpose of enabling the dice to be used in the playing of games.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides a plurality of collectible dice, each die comprising: a cube-shaped element defining six flat sides; indicia positioned on predetermined of the sides; and means in operative relationship with the element for uniquely identifying the die by electromagnetic radiation transmission and detection.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
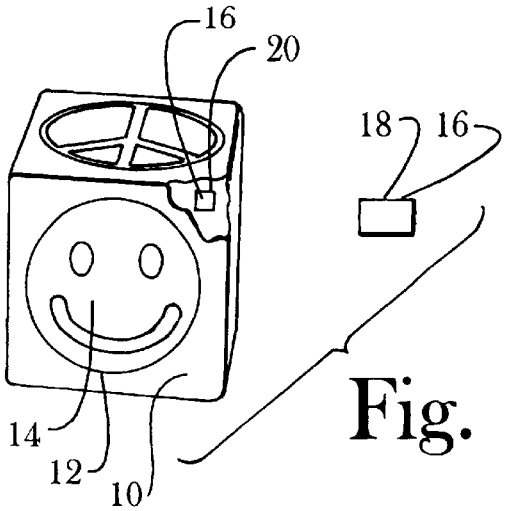
FIG. 1 is a perspective view of a collectible die.

With reference now to the drawings, wherein like reference characters designate like or corresponding parts throughout the several views, there is shown a collectible die 10 in accordance with the invention. Die 10 is comprised of a substantially cube-shaped element 12 defining six substantially flat sides, as in a conventional die.

Figure 2:
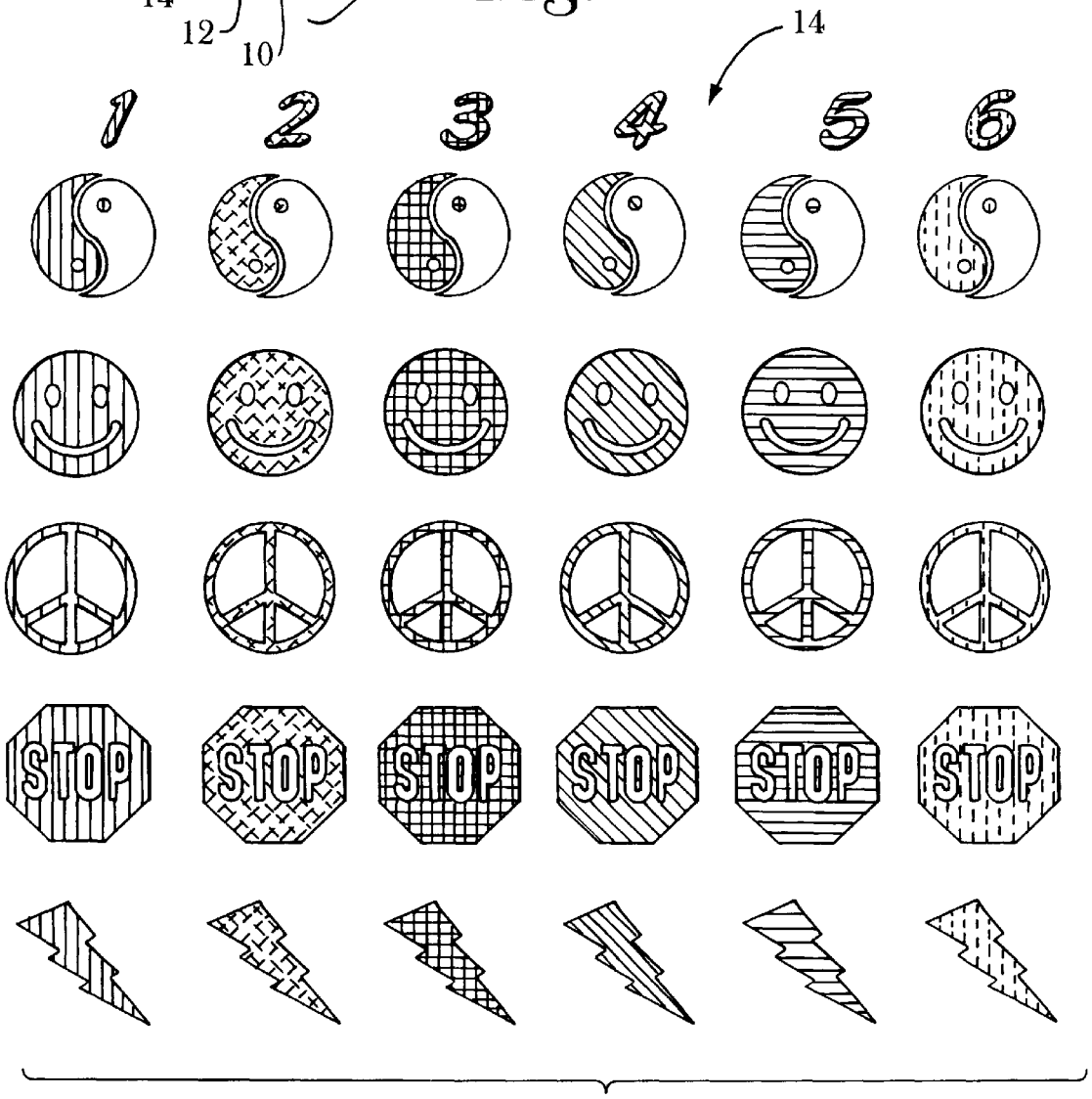
FIG. 2 shows the color-coded numbers and symbols that may be used on the sides of the dice.

Indicia 14, preferably selected from the indicia illustrated in FIG. 2 or indicia otherwise determined, are positioned on predetermined of the sides of element 12. Means 16 are provided in operative relationship with element 12 for uniquely identifying die 10 by transmitting a unique electromagnetic identifier signal or code. Means 16 also include portable receiver or reader 18 in operative relationship with transmitter or transponder 20 for receiving and reading an electromagnetic identifier signal or code transmitted from transmitter or transponder 20.

In accordance with the invention, indicia 14 preferably include a plurality of color-coded numbers and a plurality of color-coded symbols. Representative color-coded numbers and symbols are illustrated in FIG. 2. It should be understood, however, that fewer or additional symbols and/or numbers may be used and that symbols and/or numbers which are not color-coded may also be used as indicia 14. Each column of numbers and symbols in FIG. 2 is color-coded so that the numbers and symbols in each column are of the same color that is different from the colors of the numbers and symbols in the remaining columns. Of course, more or fewer than six columns of color-coded numbers and symbols may be used to change the number of unique dice that can be created.

First means, or transmitter or transponder 20, is preferably embedded or molded into each die 10 during the manufacturing process. Second means, or receiver or reader 18, is typically portable and is located externally of die 10. Transmitter or transponder 20 and receiver or reader 18 are conventionally known devices. See U.S. Pat. No. 4,730,188, as an example.

Each die 10 has indicia 14 (FIG. 2) positioned one each on each of predetermined of the sides of die 10, and indicia 14 are preferably selected from a total of at least thirty-six different indicia, as shown in FIG. 2. It should be understood, however, that, fewer, additional or different indicia from those shown in FIG. 2 may be used. Some of the sides of die 10 may not include any indicia thereon. Also, the same number or symbol can be used on more than one side of die 10. This will increase the number of unique dice that can be created.

The invention provides that a plurality of dice 10 be manufactured wherein each die 10 includes a unique combination of indicia 14, or the lack of indicia, on predetermined of the sides of the die to make each die 10 unique or one-of-a-kind. Each die 10 is preferably comprised of molded plastic, and dice 10 are manufactured with transmitter or transponder 20 embedded therein by a conventional molding process.

To protect the uniqueness of each die 10 and to prevent unauthorized duplication or counterfeiting of die 10, transmitter or transponder 20, or any other conventional electronic device which provides a unique identification signal or code by electro-magnetic radiation, is molded into each die 10. The electronic identification signal or code will be unique to each die 10 having a one-of-a-kind number/symbol combination located on the sides of the die. During the manufacturing process, the identification signal or code for each die 10 is recorded or programmed. The electronic identification signal or code of each die 10 can then be read by receiver/reader 18, which is a conventional scanning device, to determine if the detected identification signal or code is an authentic signal or code which has previously been recorded/programmed and registered during the manufacturing process. By use of receiver/reader 18, a collector can determine whether a die 10 is authentic or if it is a counterfeit.

Figure 3:
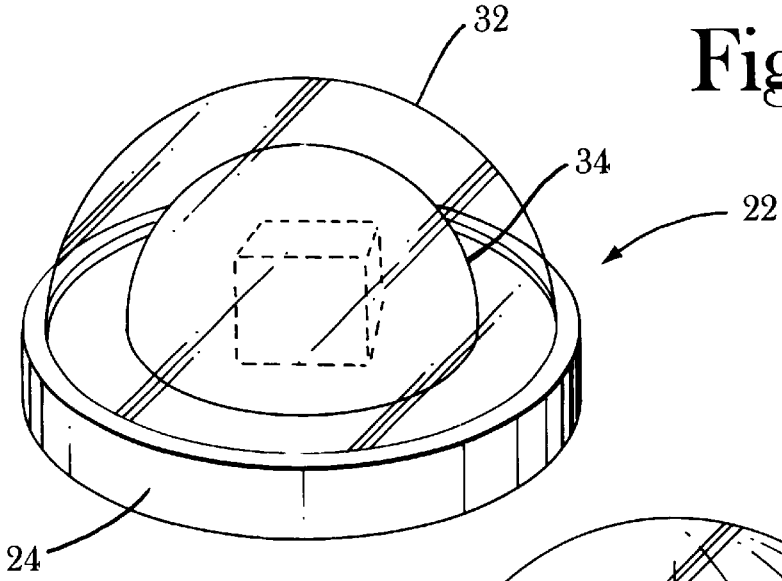
FIG. 3 is a perspective view showing the packaging system for each die.
Figure 4:
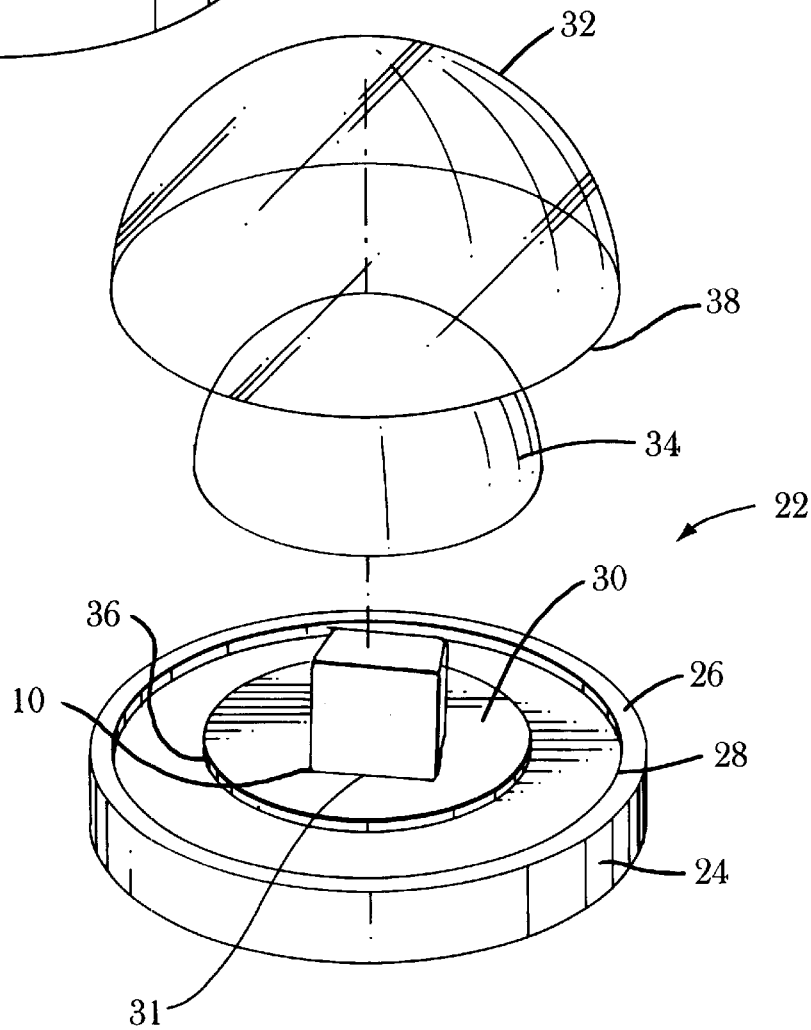
FIG. 4 is a perspective view of the packaging system with the inner, opaque cover removed to display the die.

Each die 10 will be sold in a packaging system 22, shown in FIGS. 3 and 4.

Packaging system 22 comprises a base 24 which defines an upper surface 26 and a first groove 28 defined within surface 26. Base 24 further defines a predetermined location 30 thereon for receiving a die 10 on location 30.

Packaging system 22 further includes a first transparent cover 32 configured for removably fitting within groove 28 and for covering die 10 when the die is positioned on location 30. A second smaller cover 34 is configured for removably fitting over location 30, for positioning between base 24 and cover 32, and for covering die 10 when the die is positioned on location 30. Each of covers 32, 34 is preferably hemispherical, and cover 34 is preferably opaque to hide die 10 from view.

Location 30 is preferably raised upwardly from upper surface 26 of base 24 to form a display pedestal 36 for die 10, and surface 26 is preferably flat. Location 30 may include an indentation or footprint 31 to secure die 10 in place while in transit or on display.

To properly receive circular edge 38 of transparent cover 32 within groove 28, groove 28 is also circular. It should be understood, however, that covers 32, 34 may be configured in shapes other than hemispherical. In those embodiments of the invention, the shapes of groove 28 and pedestal 36 will be such that they will properly receive and accommodate covers 32, 34.

Transparent cover 32 may include a conventional coating thereon to protect die 10 from ultraviolet rays. A conventional plastic wrap, not shown, can be positioned around packaging system 22 to prevent tampering with the packaging system prior to sale.

Inner dome 34 covers die 10 and protects the identity of die 10 until purchase and opening by the consumer. After purchase, inner dome 34 can be removed and transparent outer dome 32 can be repositioned within groove 28 and over die 10 to create a protective display case for die 10.

The invention in its broader aspects is not limited to the specific details shown and described, and departures may be made from such details without departing from the principles of the invention and without sacrificing its chief advantages.

What is claimed is:

1. A one-of-a-kind collectible die, comprising:

a plurality of substantially cube-shaped elements defining six substantially flat sides;

said elements are comprised of a molded plastic material in a plurality of colors;

a plurality of color-coded indicia positioned on predetermined said sides;

each said element of each said color of plastic includes a unique combination of said color-coded indicia on predetermined said sides;

each said element includes an embedded transmission device capable of transmitting a unique identification signal or code;

each said element includes said unique combination of color-coded indicia on predetermined sides and said embedded transmitter device capable of transmitting a unique identification signal or code to make each said element a one-of-a-kind collectible;

each said one-of-a-kind collectible is uniquely identified and authenticated by the combination of said color of plastic, said unique combination of color-coded indicia on predetermined sides, and said embedded transmitter device capable of transmitting a unique identification signal or code;

each said combination on each said one-of-a-kind collectible appears only once in the entire population of one-of-a-kind collectible die;

said combinations of said one-of-a-kind collectible die provision for said population in the millions and said population is only limited by the number of unique combinations of said colors of plastic, said color-coded indicia, and said transmitter devices capable of transmitting unique identification signals or codes.

2. A packaging system for concealing the identity of one-of-a-kind collectible die, comprising:

a circular base defining a predetermined location thereon for receiving the one-of-a-kind collectible die of claim 1 on said location;

said location is raised upwardly from said upper surface of said base to form a circular display pedestal for said die;

a hemispherical opaque cover removably fitted over said location and said pedestal to hide die from view until opened;

a second hemispherical transparent cover removably fitted over said hemispherical opaque cover and within said first groove.

* * * * *